US009452849B2

(12) United States Patent
Landskroner et al.

(10) Patent No.: US 9,452,849 B2
(45) Date of Patent: Sep. 27, 2016

(54) FLAVOR AND PORTION CONTROLLER

(71) Applicants: David Justin Landskroner, Philadelphia, PA (US); David Ian Weissman, Woodbury, NY (US)

(72) Inventors: David Justin Landskroner, Philadelphia, PA (US); David Ian Weissman, Woodbury, NY (US)

(73) Assignee: DSQUARED INNOVATIONS, INC., Elkins Park, PA (US)

( * ) Notice: Subject to any disclaimer, the term of this patent is extended or adjusted under 35 U.S.C. 154(b) by 27 days.

(21) Appl. No.: 14/204,942

(22) Filed: Mar. 11, 2014

(65) Prior Publication Data

US 2014/0261857 A1 Sep. 18, 2014

Related U.S. Application Data

(60) Provisional application No. 61/791,317, filed on Mar. 15, 2013.

(51) Int. Cl.

| | |
|---|---|
| ***B65B 1/04*** | (2006.01) |
| ***B65B 3/26*** | (2006.01) |
| ***B65B 57/06*** | (2006.01) |
| ***B65B 61/20*** | (2006.01) |
| *B65B 25/00* | (2006.01) |

(52) U.S. Cl.

CPC ..... *B65B 3/26* (2013.01); *B65B 57/06* (2013.01); *B65B 61/207* (2013.01); *B65B 25/007* (2013.01); *B65B 2220/14* (2013.01)

(58) Field of Classification Search

CPC ..... B65B 3/26; B65B 3/30
USPC ..... 141/1; 220/500, 520, 528–531, 552
See application file for complete search history.

(56) References Cited

U.S. PATENT DOCUMENTS

| | | | | |
|---|---|---|---|---|
| 1,038,644 | A * | 9/1912 | Phin | 206/459.5 |
| 3,458,078 | A * | 7/1969 | Skidmore | B65D 25/04 206/223 |
| 4,966,295 | A * | 10/1990 | Parrish | A47G 19/025 206/459.1 |
| 2011/0100999 | A1* | 5/2011 | Clayton | B65D 25/04 220/529 |
| 2014/0110283 | A1* | 4/2014 | Baugh | B65D 25/08 206/221 |
| 2014/0158694 | A1* | 6/2014 | Martin | B65D 85/78 220/529 |

OTHER PUBLICATIONS

Hanlon, Mike, 'Siemens develops printable, low-cost, disposable video display', Nov. 6, 2005, http://www.gizmag.com/go/4821/.*

* cited by examiner

*Primary Examiner* — Jason K Niesz

(57) ABSTRACT

An example method for analyzing data in a collaborative network in accordance with the present disclosure is receiving a configuration of a divider, the divider being placed in a container, identifying a number of compartments in the container based on the configuration of the divider, determining a size for each compartment in the container based on the configuration of the divider, and storing a portion size for each food product based on the size of each compartment.

18 Claims, 6 Drawing Sheets

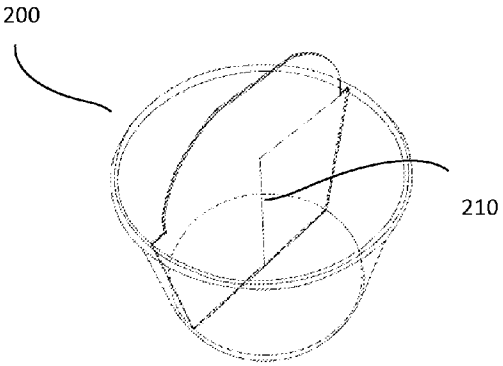
Fig. 2A
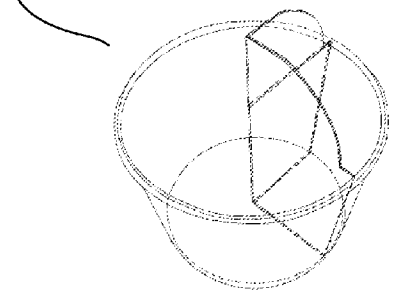
Fig. 2B
Fig. 2C
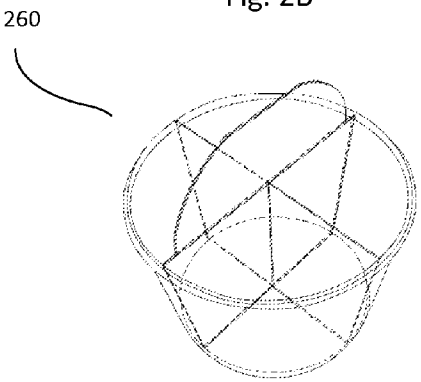
Fig. 2D

FLAVOR AND PORTION CONTROLLER

BACKGROUND

On-site sales of food and drinks have become a principal consumer industry in the United States and the world. Typically, a consumer is offered a selection of foods and beverages from which to select and then carry-out from the point of purchase for consumption. Accordingly, food is served in containers of various shapes, sizes and materials.

BRIEF DESCRIPTION OF THE DRAWINGS

Example implementations are described in the following detailed description and in reference to the drawings, in which:

FIGS. 2A, 2B, 2C and 2D illustrate of perspective views of an example flavor portion controller system in accordance with an implementation;

DETAILED DESCRIPTION

Various implementations described herein are directed to a flavor and portion controller system including a divider. More specifically, and as described in greater detail below, various aspects of the present disclosure are directed to a manner by which different types of food products may be maintained separately in one container. This approach allows limiting the number of containers being used.

Aspects of the present disclosure described herein provide a container, with the use of a divider, having multiple separated internal compartments for holding food products. Among other things, this approach may control the types of food products for each section in addition to controlling the portion sizes of each type of food product placed in each section of the container.

In one example in accordance with the present disclosure, a method for providing a portion and flavor controller is provided. The method comprises receiving a configuration of a divider, the divider being placed in a container, identifying a number of compartments in the container based on the configuration of the divider, determining a number of food products being placed in the container based on the number of compartments, identifying a size for each compartment in the container based on the configuration of the divider, and identifying a portion size for each food product based on the size of each compartment.

In another example in accordance with the present disclosure, a method for providing a portion controller for food products in a container is provided. The method comprises receiving, from a user, a configuration of a divider, the divider being placed in a container, identifying a size for each compartment in the container based on the configuration of the divider, and identifying a portion size for each food product based on the size of each compartment.

In another example in accordance with the present disclosure, a method for providing a flavor controller for food products in a container is provided. The method comprises receiving, from a user, a configuration of a divider, the divider being placed in a container, identifying a number of compartments in the container based on the configuration of the divider, and determining a number of food products being placed in the container based on the number of compartments, each food product identifying a flavor.

In a further example in accordance with the present disclosure, a system for providing a portion and flavor controller for food products is provided. The system comprises a container; and a divider for insertion in the container for dividing the container into to divide the container into a plurality of compartments, the divider having four panels used to create the compartments and being capable of standing alone separate from the container.

Figure 1:
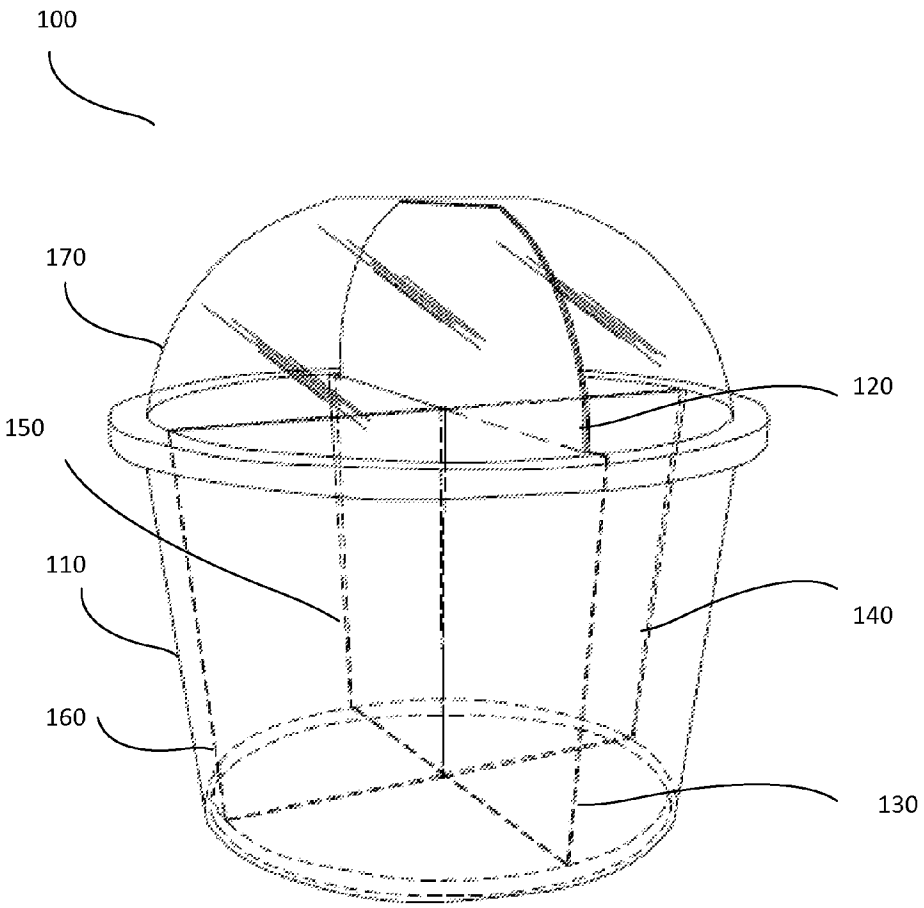
FIG. 1 illustrates a perspective view of an example flavor portion controller system in accordance with an implementation.

FIG. 1 illustrates an example flavor portion controller system 100 in accordance with an implementation. The system 100 comprises a container 110, a divider 120 adapted to divide the cup into compartments using panels 130, 140, 150 and 160, and a lid 170, each of which is described in greater detail below. It should be readily apparent that the system 100 depicted in FIG. 1 represents a generalized illustration and that other components may be added or existing components may be removed, modified, or rearranged without departing from a scope of the present disclosure. For example, while the system 100 illustrated in FIG. 1 includes a lid 170, the system may actually comprise no lid, and one has been shown and described for simplicity.

The container 110 may be a conventional container in any form, including, but not limited to, a cardboard cup, paperboard cup, carton or box. The container 110 may have various sizes, shapes and colors. The container 110 may have a cavity formed by side walls and a bottom. In one implementation, the container 110 may be used to hold a food product. The food product may include, but not limited to, ice cream (e.g., soft-serve ice cream), sorbet, yogurt, frozen yogurt, frozen custard, and/or another food products.

The divider 120 may be employed for insertion into the container 110 to divide the container 110 into any desired number of sections. When inserted into the container 110, the divider 120 may transform the container 110 into a unit which provides separated compartments for holding different food products. The divider 120 alternatively may be formed as one piece integral with the container 110 where desired.

The divider 120 may comprise one or more panels, for example, 4 panels. The divider 120 may be a flat structure, although any other desired configuration may also be utilized. With the panels, the divider 120 may act as a partitioner and partition the container 110 into up to a plurality of sections. In one example, the divider 120 may partition the cup into 4 sections. When the divider 120 partitions the cup into a plurality of section (e.g., four), each section is isolated from one another such that each section is liquid-tight or solid-tight compartments. The divider 120 is separate from the container 110 and may support itself in an upright position. The divider 120 is formed in such a manner that it may be collapsed to flat configuration when not in use. For use, the consumer may erect the folded panels by unfolding, i.e., spreading several of the panels apart from each other, with the partition then being placed into the container 110.

The divider 120 may be formed from any suitable materials, such as a sheet of food-safe material. For example, the food-safe material may include, but not limited to, paperboard, plastics, styrofoam and/or alike. The divider 120 may have an outer perimeter sized and shaped to be received in the container 110. The divider 120 may be configured to extend along the inner sides of the container 110 all the way from the bottom of the divider 120 at or near the bottom of the container 110 to a position at or above the top of the container 110.

The divider 120 may be a multi-purpose divider. The divider may be used to as a divider to divide the container into a plurality of compartments. In addition or alternatively, the divider 120 may be used as a paperboard partition for spacing and supporting food products in the container 110. Further, the divider 120 may be used to control portions of the food products being placed into the container 110. In such an example, the divider 120 acts as a portion controller. Moreover, the divider 120 may also be used to control the number of types of food products that may be placed into the container 110. In such an example, the divider 120 acts a flavor controller.

The divider 120 may be formed of a paper product and may include a double thickness primary portion formed of a pair of divider panels 130 and 150 joined together. The divider 120 may have one or more additional panels, such as two panels 140 and 160 that extend to the sides. When opened, the panels 140 and 160 may extend normal to the divider panels 130 and 150. In one implementation, the panels 130, 140, 150 and 160 may create compartments in the container 110 that may be about equal in size and shape (e.g., mirror images of one another. In another implementation, the compartments that the panels create may all be different sizes. The flavor portion controller allows the consumer to adjust the sizes by moving the panels. When in collapsed form, the divider 120 may be stored flat. In one implementation, the compartments size may be determined based on serving sizes of the food being placed into each compartment. For example, the portion of the compartment used for chocolate flavored whole milk ice cream may be smaller than the portion of the compartment used for the sugar-free vanilla frozen yogurt as the sugar-free vanilla frozen yogurt has less calories than the ice cream and therefore, can be eaten in larger quantity per serving.

In one implementation, the divider 120 may be custom designed for the container 110. For example, the bottom of the divider 120 may be shaped to conform precisely to the bottom of the container 110. Accordingly, when the divider 120 is inserted into the container 110, a possible gap between the divider 120 and the bottom of the container 110 may be minimized.

In one implementation, the flavor portion controller system 100 may include a lid 170. The lid 170 is shown as a dome shaped lid in FIG. 1. In other implementation, the lid may be in other shapes (e.g., flat, or squared). The lid may be fitted over the open top of the cup. In one exam lid may be stable. In another example, the lid may be removable.

The divider 120 has an upper shape to conform to and extend along the underside of an optional lid (e.g., dome shaped lid) that may be secured to the top of the container 110. The top portion of the divider 120 may be separated from the body of the divider 120 to accommodate different shapes of lids. For example, the tear off portion of the divider 120 may be separated from the main body of the divider 120 in order to provide clearance for a flat lid. The consumer can detach the tear off portion from the rest of the divider before filling the container 110 with a food product or before discarding the container 110 and main body of the divider after use.

FIGS. 2A, 2B, 2C and 2D illustrate perspective views of the flavor portion controller system 100 in accordance with one implementation. It should be understood that the systems 200, 220, 240, and 260 in the figures represent a generalized illustration and that other components may be added or existing components may be removed, modified, or rearranged without departing from a scope of the present disclosure.

In FIGS. 2A, 2B, 2C and 2D, the panels of the divider 120 are defined by the fold line 210. The panels may be moved by the consumer before the consumer or the vendor dispenses any food product into the container 110. By moving the panels of the divider 120 to create and adjust compartments in the container 110, the consumer demonstrates that he is in control of determining the number of compartments in the container 110 and the size of the compartments. This also determines how many flavors the consumer wants and/or how much of each flavor he wants. The divider 120 provides the consumer the flexibility to consume different combinations of food product (e.g., different flavors, etc.) in the different compartments of different sizes.

FIG. 2A illustrates an example system 200, where two panels of the divider 120 are folded while the other two are fully open at a 180 degree angle. FIG. 2A further illustrates that the panels are defined by the fold line 210. In this configuration, the divider 120 of the system 200 divides the container 110 into two sections of equal sizes.

FIG. 2B illustrates an example system 220, where the two of the panels of the divider 120 are folded away, and the other two are separated from one another at a 45 degree angle. This again allows the user to separate the container 110 into two compartments. In addition, this arrangement also allows the user to identify different sizes for different compartments. For example, in FIG. 2B, the first compartment being a quarter of the size of the container 110, whereas the second compartment being three quarters of the container 110.

FIG. 2C illustrates an example system 240, where three panels of the divider 120 are open while the fourth one is folded. Accordingly, this configuration results in three compartments, two of which having the size of a quarter of the container 110, and a third one being half of the container 110. Such configuration allows the consumer select three different flavors of food product and determine which flavors he wants to place in the two, one quarter size compartments, and which flavor in the half size compartment.

FIG. 2D illustrates an example system 260, where all the panels of the divider 120 are open. Accordingly, this results in four compartments in the container 110, and allows the consumer to select up to four different flavors of food product.

FIGS. 3A, 3B, 3C and 3D illustrate top plan views of the flavor portion controller system 100 with food product in accordance with one implementation. It should be understood that the systems 300, 320, 340, and 360 in the figures represent a generalized illustration and that other components may be added or existing components may be removed, modified, or rearranged without departing from a scope of the present disclosure.

In one implementation, the divider 120 may be employed to identify a size of an order of the food product. For example, a small order may be identified as filling one quarter of the cup with a food product. Similarly, a medium order may be defined as the half of the cup (two quarters), and a large order may be defined as the three fourth of the cup (three quarters), whereas an extra-large order may be a full cup (four quarters).

Figure 3A:
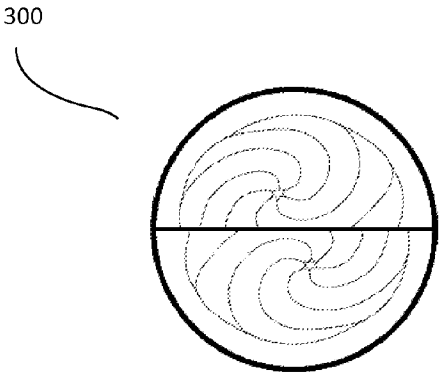
FIGS. 3A, 3B, 3C and 3D illustrate top plan views of an example stand-alone flavor portion controller containing at least one food product in accordance with an implementation.
Figure 3B:
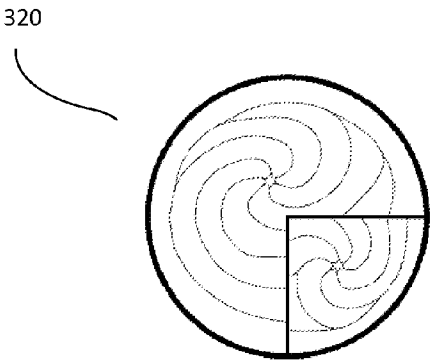

In FIGS. 3A, 3B, 3C and 3D, the container 110 is at least partially filled with a food product (e.g., frozen yogurt, ice cream, sorbet, gelato, yogurt, sauces, topping). The divider 120 may be provided to the consumer by the product vendor. A consumer may use the divider 120 as described above and places it in the container 110 to divide the container into a plurality of compartments. For example, the consumer may dispense frozen yogurt into each of the compartments. The consumer may dispense a different flavor of frozen yogurt into each compartment, and decide the portion size of each flavor based on the compartments created with the divider 120. For example, as illustrated in FIG. 3A, the consumer may choose to have chocolate and vanilla flavors of frozen yogurt, both in sizes equal to the half of the cup. In FIG. 3B, the consumer may still choose to have two flavors of frozen yogurt, chocolate and vanilla. However, in this case, the consumer may choose to have more chocolate than vanilla, and determines the desired portions for each flavor as one quarter size of vanilla, and three quarters size of chocolate frozen yogurt.

In one implementation, the consumer may choose to have the same flavor in more than one compartment. In such implementation, the consumer may to add various toppings to each compartment. Toppings may include, but not limited to, various nuts, cereal, fruit, candy, and/or flavored sauces or syrups. Accordingly, the divider may be used to separate toppings in addition or alternatively to separating flavors. The contents of the compartments may be the same or different from one another (e.g., have different flavors and same toppings, and/or same flavors with different toppings). For example, the consumer may have vanilla flavored frozen yogurt with sprinkles, and vanilla flavored frozen yogurt with fruit toppings in the container.

Figure 3C:
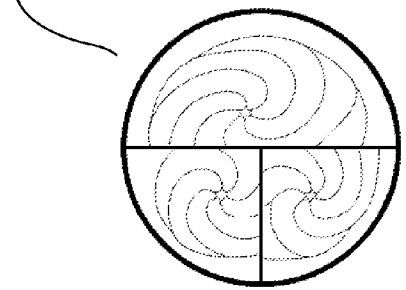

In FIG. 3C, the consumer may choose to have three flavors of frozen yogurt, chocolate, vanilla and strawberry. The consumer may determine the portions for each flavor by again using the divider 120, and determines the flavor portions as one quarter size of chocolate, one quarter size of vanilla and half container size of strawberry. In another implementation, the consumer may choose not to fill one of the compartments. For example, the consumer may choose to skip chocolate and instead leave that one quarter compartments empty in FIG. 3C.

Figure 3D:
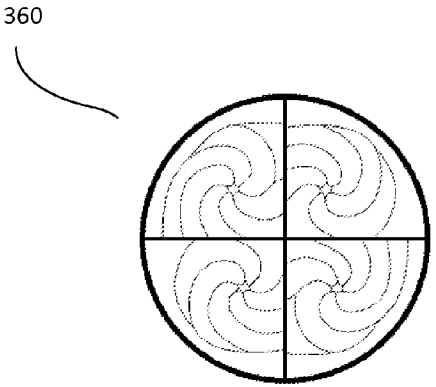

In FIG. 3D, the consumer may choose four flavors of frozen yogurt, and fill each quarter size compartment with one of the flavors.

FIGS. 4A, 4B, 4C and 4D illustrate an example divider 120 in accordance with an implementation. It should be readily apparent that the divider 120 depicted in FIGS. 4A, 4B, 4C and 4D represents a generalized illustration and that there may be variations in the design of the divider 120 in other implementation in accordance with the present disclosure.

As illustrated in FIGS. 4A, 4B, 4C and 4D, the divider 120 may support itself in an upright position. The divider 120 may be constructed of a material that can stand upright position. Accordingly, the divider 120's ability to stand on its own is not dependent on the food product that may be placed in it.

Figure 4A:
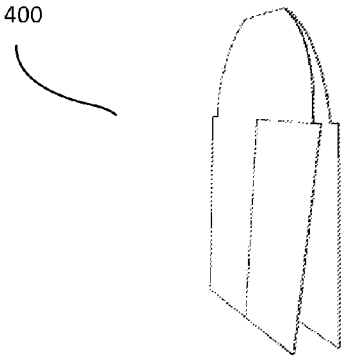
FIGS. 4A, 4B, 4C and 4D illustrate perspective views of an example stand-alone divider in an example flavor portion controller system in accordance with an implementation.
Figure 4B:
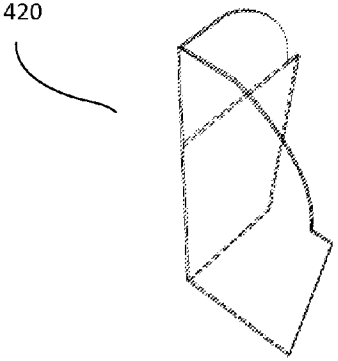
Figure 4C:
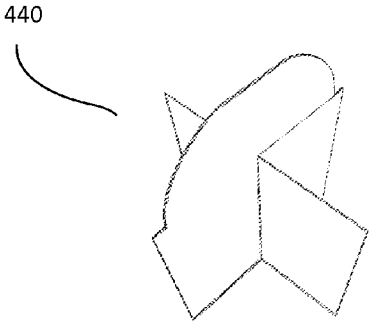
Figure 4D:
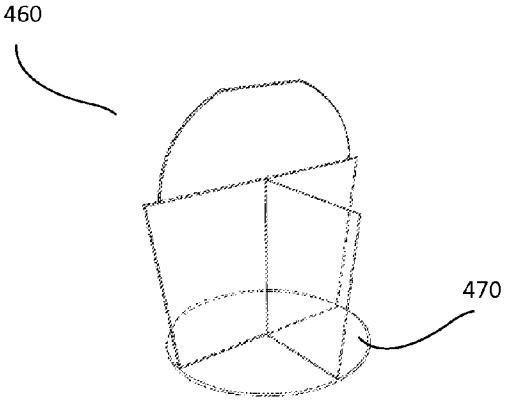

FIG. 4D illustrates an example divider 120 includes an attached base 470 in accordance with an implementation. In one implementation, when inserted into a container, the base 470 of the divider 120 may sit on top of the base of the container 110. Accordingly, the divider 120 may provide a multi-compartment storage container which is capable of holding both solids and liquids simultaneously while maintaining separation between the various products. The base 470 of the divider 110 may prevent leakage of liquid from one section to another. For example, if the container 110 is used for frozen yogurt, a plurality of flavors of frozen yogurt may be dispensed into different sections of the container 110. Even if one of the flavors in one of the sections melt and turn into liquid, the divider 120 may still maintain the separation between different flavors in different compartments of the divider 120.

Figure 5B:
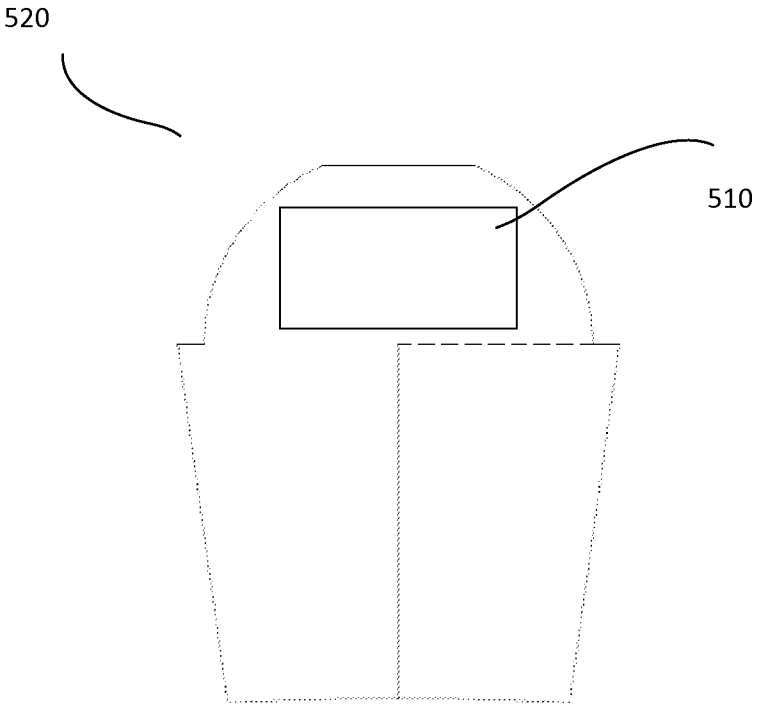
FIGS. 5A and 5B illustrates side views of an example stand-alone divider in an example flavor portion controller system in accordance with an implementation.
Figure 5A:
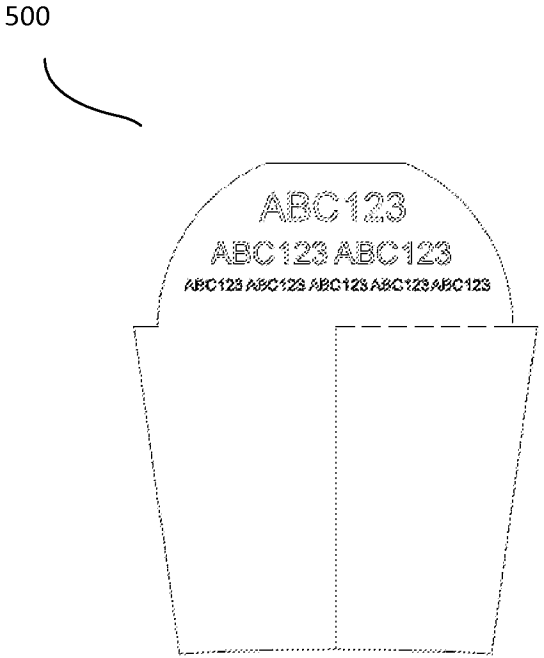

FIGS. 5A and 5B illustrate an example divider 120 in accordance with an implementation. It should be readily apparent that the divider 120 depicted in FIGS. 5A, and 5B represents a generalized illustration and that there may be variations in the design of the divider 120 in other implementation in accordance with the present disclosure. Moreover, other components may be added or existing components may be removed, modified, or rearranged without departing from a scope of the present disclosure. For example, while the divider 120 illustrated in FIG. 5B includes only one display 510, the divider 120 may actually comprise a plurality of displays, and only one has been shown and described for simplicity.

In FIG. 5A, the divider 500 comprises chosen text or logo to be displayed on the divider 120. The chosen text or logo may include, but not limited to, one or more of the following: instructions, product information, product name, vendor name, vendor logo, a promotional game or contest, a barcode (e.g., a smart phone readable one-dimensional or two-dimensional/matrix barcode including but not limited to QR Code, etc.) and a coupon.

In one implementation, the chosen text or logo may be printed on the divider 120. In another implementation, chosen text or logo may be placed on the divider 120 with an adhesive material (e.g., glue, sticker, etc.). In one implementation, the chosen text or logo may be placed on the upper portion of the divider (e.g., the portion extending above the top of the container 110) where they are more likely to be visible when the container 110 is full. In another implementation, the text or logo may be positioned anywhere else on the divider 500. In a further implementation, the text or logo may be placed on the entire sides of the divider 500.

In FIG. 5B, the divider 520 comprises a display 510. In one implementation, the display 510 may be used to provide instructions. For example, a video may be played, or a line of instructional text (e.g., amount of calories, ingredients, etc.) may be shown. In another implementation, the display may be used to identify a food product or a vendor providing the food product. For example, the name or logo of the vendor may be displayed. In a further implementation, the display may be used as an advertisement tool. For example, the vendor may run a game or other promotion using the features of the divider described above.

In one implementation, the display 510 may be an electronic display (such as an LCD or LED screen). In another implementation, the display 510 may display data in various formats, including, but not limited to, digital images in a format of JPEG, GIF, PNG, etc., audio content in a format of MP3, WAV, WMA, etc., video content in a format of MPEGx, H.264, AVS, AVI, etc. The content may be one type or a mix of a plurality of types.

The display may be linked to a user device (e.g., a laptop, desktop, tablet, smart phone, medical instrument, scientific instrument, etc.). The display 520 may include a processor and memory and help translate input data received from the user device into appropriate feedback for the display 510. The processor and the computer readable medium may be connected via a bus. The computer readable medium may comprise various databases containing, for example, a food product database, a vendor database, a consumption database and a display content database.

The processor may retrieve and execute instructions stored in the computer readable medium. The processor may be, for example, a central processing unit (CPU), a semiconductor-based microprocessor, an application specific integrated circuit (ASIC), a field-programmable gate array (FPGA) configured to retrieve and execute instructions, other electronic circuitry suitable for the retrieval and execution instructions stored on a computer readable storage medium, or a combination thereof. The processor may fetch, decode, and execute instructions stored on the storage medium to operate the system 100 in accordance with the above-described examples. The computer readable medium may be a non-transitory computer-readable medium that stores machine readable instructions, codes, data, and/or other information.

In certain implementations, the computer readable medium may be integrated with the processor, while in other implementations, the computer readable medium and the processor may be discrete units.

Further, the computer readable medium may participate in providing instructions to the processor for execution. The computer readable medium may be one or more of a non-volatile memory, a volatile memory, and/or one or more storage devices. Examples of non-volatile memory include, but are not limited to, electronically erasable programmable read only memory (EEPROM) and read only memory (ROM). Examples of volatile memory include, but are not limited to, static random access memory (SRAM) and dynamic random access memory (DRAM). Examples of storage devices include, but are not limited to, hard disk drives, compact disc drives, digital versatile disc drives, optical devices, and flash memory devices.

In one implementation, the computer readable medium may have a food product database, a vendor database, a consumption database and a display content database. For example, the food product database may store product data such as ingredients, calorie count, nutritional value, expiration date and/or the like. The vendor database may include, but not limited to, vendor name, address, store hours, product list, and/or alike. In another implementation, these databases may be located in the user device and linked to the divider 520 via a network.

The processor may comprise at least one high-speed data processor adequate to execute program components for executing user and/or system-generated requests. In one implementation, the processor may include a software module that processes the data including time, location, store information, food product and/or alike. This module may also be used to capture information about consumption behavior of a consumer or sales information of a store or vendor. Moreover, the processor may include a software module that runs advertisements to be displayed on the screen on the divider 520. Such advertisements may be based on the data captured about the consumer. Accordingly, the advertisements may be targeted to the consumer based on their consumption behavior or any other data that may be relevant.

In some implementations, the consumer may interact with the display 510 by controlling an input device (e.g., keyboard on a mobile device, etc.) through a user interface (e.g., mobile device) attached to the display 510 and/or the display device 170. The user interface may be a display of a mobile device. In one example system, such display may present various pages that represent applications available to the consumer. The user interface may facilitate interactions of the consumer with the display 510 by inviting and responding to input from the consumer and translating tasks and results to a language or image that the display 510 can understand. In another implementation, the display 510 may be a touch sensitive display device and act as a user interface for the consumer.

Figure 6:
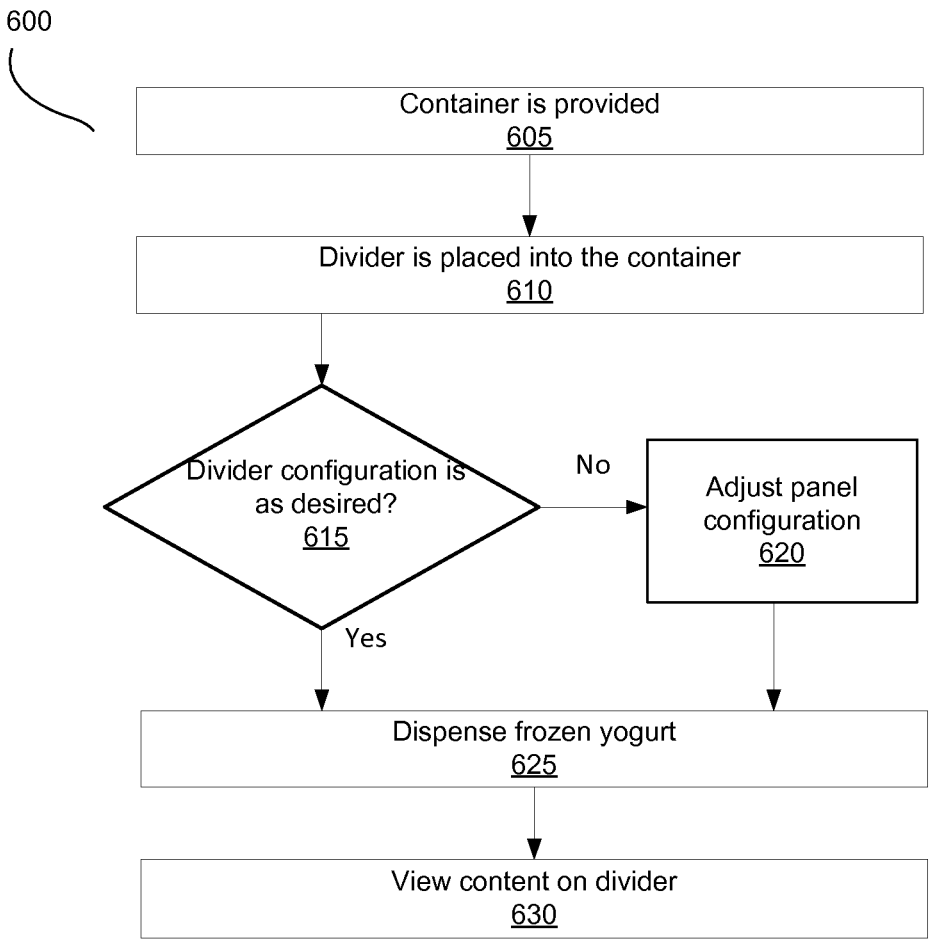
FIG. 6 illustrates an example process flow diagram in accordance with an implementation.

Turning now to the operation of the system 100. FIG. 6 illustrates an example process flow diagram 600 in accordance with an implementation. More specifically, FIG. 6 illustrates processes that may be conducted by the system 600 in accordance with an implementation. It should be readily apparent that the processes illustrated in FIG. 6 represents generalized illustrations, and that other processes may be added or existing processes may be removed, modified, or rearranged without departing from the scope and spirit of the present disclosure.

The process 600 may begin at block 605, where a container is provided to a consumer by a vendor. As discussed above in more detail in reference to FIG. 1, the vendor may be an owner of a self-serve frozen yogurt store, and the container may be for holding frozen yogurt. The vendor may allow the consumer to dispense the frozen yogurt into the containers. In another implementation, the vendor dispenses the frozen yogurt into the containers himself. As also discussed above, the divider may be configured to match a shape of a container the vendor uses such that the consumer can place the divider into the container.

At block 610, the user places the divider into the container. In particular, this process may involve folding or unfolding panels of the divider based on the consumer's preference as to the number and size of compartments to be created.

Once the divider is positioned in the container, at block 615, the user may check if the configuration matches the number of compartments the consumer needs (based on the number of frozen yogurt flavors the consumer plans to pick). In addition, this process may also involve checking if the sizes of the compartments match the consumer's preference for the size of each flavor the consumer plans to order.

In the event that the size and number of the compartments do not match the consumer's desired order plan, at block 620, the consumer may adjust the panels of the divider. In the event that the consumer is content with the configuration of the divider in the container, at block 625, the consumer may proceed to dispense frozen yogurt into the container.

After dispensing the frozen yogurt into the container, while enjoying the frozen yogurt, at block 630, the consumer may view the content (text, image, audio, etc.) that may be shared on the divider (e.g., a display on the divider). In another implementation, the consumer may choose to interact with the display on the divider to change, skip or delete some of the content.

In certain implementation, the display may be turned off when the user chooses to turn it off. Alternatively or in addition, the system may cause the display to turn off when the container is empty.

The present disclosure has been shown and described with reference to the foregoing exemplary implementations. It is to be understood, however, that other forms, details, and examples may be made without departing from the spirit and scope of the disclosure that is defined in the following claims. As such, all examples are deemed to be non-limiting throughout this disclosure.

What is claimed is:

1. A method for providing a portion and flavor controller for food products in a container, comprising:

receiving a configuration of a one piece divider, the one piece divider placed in a container and having a plurality of panels and a base;

identifying a number of compartments in the container based on the configuration;

determining a size for each compartment in the container based on the configuration of the divider;

adjusting the panels to achieve the identified number of compartments; and storing a portion size of each food product based on the size of each compartment, wherein the base maintains separation of each food product between compartments.

2. The method of claim 1, wherein the food products include a plurality of frozen yogurt flavors.

3. The method of claim 1, wherein the portion size for each food product is reflective of serving size associated with corresponding food product.

4. The method of claim 1, wherein the configuration of the divider is received from a user.

5. The method of claim 4, wherein the user is a consumer of the food products.

6. The method of claim 1, wherein the divider separates the food products in the container.

7. The method of claim 1, wherein the compartments have different sizes.

8. The method of claim 1, further comprising modifying the size of each compartment in the container based on food product selected for each compartment.

9. The method claim 1, further comprising displaying content on the divider.

10. The method claim 9, wherein the content comprises text, images, and videos.

11. The method of claim 1, further comprising identifying a number of additions placed into the container.

12. A method for providing a portion controller for food products in a container, comprising:

receiving a configuration of a one piece divider, the one piece divider being placed in a container and having a plurality of panels and a base;

identifying a number of compartments in the container based on the configuration;

identifying a size for each compartment in the container based on the configuration of the divider;

adjusting the panels to achieve the identified number of compartments; and storing a portion size for each food product based on the size of each compartment, wherein the base maintains separation of each food product between compartments.

13. The method of claim 12, wherein the divider is capable of standing alone separate from the container.

14. A system for providing a portion and flavor controller for food products, comprising:

a container; and a one piece divider for insertion in the container for dividing the container into a plurality of compartments, the one piece divider having a base and a plurality of panels used to create the compartments and being capable of standing alone separate from the container, wherein:

the one piece divider has a configuration, the container has a number of compartments determined based on the configuration, the panels of the container are adjusted to achieve the identified number of compartments, and the base maintains separation of each food product between the compartments.

15. The system of claim 14, wherein the container is used to hold food products.

16. The system of claim 15, wherein the food products comprise a plurality flavors of frozen yogurt.

17. The system of claim 13, further comprising a display unit to display content.

18. The system of claim 16, wherein the content comprises advertisements, instructions, food product information, logo and/or alike.

* * * * *